US008365512B2

(12) United States Patent
Valentian

(10) Patent No.: US 8,365,512 B2
(45) Date of Patent: Feb. 5, 2013

(54) EMITTER FOR IONIC THRUSTER

(75) Inventor: Dominique Valentian, Rosny sur Seine (FR)

(73) Assignee: SNECMA, Paris (FR)

( * ) Notice: Subject to any disclaimer, the term of this patent is extended or adjusted under 35 U.S.C. 154(b) by 793 days.

(21) Appl. No.: 12/527,916

(22) PCT Filed: Feb. 21, 2008

(86) PCT No.: PCT/FR2008/050292
§ 371 (c)(1),
(2), (4) Date: Sep. 9, 2009

(87) PCT Pub. No.: WO2008/113942
PCT Pub. Date: Sep. 25, 2008

(65) Prior Publication Data

US 2010/0018185 A1 Jan. 28, 2010

(30) Foreign Application Priority Data

Feb. 21, 2007 (FR) ..... 07 53407

(51) Int. Cl.
*F03H 1/00* (2006.01)

(52) U.S. Cl. ..... 60/202

(58) Field of Classification Search ..... 60/202; 313/360.1, 361.1, 362.1, 363.1; 315/111.81
See application file for complete search history.

(56) References Cited

U.S. PATENT DOCUMENTS

| | | | | |
|---|---|---|---|---|
| 4,318,028 | A * | 3/1982 | Perel et al. | 315/111.81 |
| 4,328,667 | A | 5/1982 | Valentian et al. | |
| 4,453,078 | A * | 6/1984 | Shimizu | 250/425 |
| 4,598,231 | A * | 7/1986 | Matsuda et al. | 315/111.81 |
| 6,516,604 | B2 * | 2/2003 | Mojarradi et al. | 60/202 |
| 7,567,026 | B2 * | 7/2009 | Chen | 313/361.1 |
| 7,827,779 | B1 * | 11/2010 | Krishnan et al. | 60/202 |

FOREIGN PATENT DOCUMENTS

FR 2510304 1/1983

OTHER PUBLICATIONS

Andrenucci, M. et al., "Development of an Annular Slit Ion Source for Field Emission Electric Propulsion," AIAA-85-2069; AIAA/DGLR/JSASS 18th International Electric Propulsion Conference, Alexandria, VA, Sep. 30-Oct. 2, 1985, pp. 1-12.

"Industrial Policy Committee. List of Intended Invitations to Tender 2006. Open and Restricted Competitive Tenders. (ESA/IPC, Rev. 11)" Internet citation, Jun. 2006, XP007903137, URL: http://emits.esa.int/emits-doc/emitsdata/booklets/C2006-11-111.pdf, p. 125.

He, J. et al., "Theoretical study of the field distributions in a linear electrohydrodynamic charged particle source for space applications," Solid-State Electronics; Elsevier Science Publishers, Barking, GB, vol. 45, No. 6, Jun. 2001, pp. 817-829.

(Continued)

*Primary Examiner* — Phutthiwat Wongwian

(74) *Attorney, Agent, or Firm* — Preti Flahery Beliveau & Pachios LLP

(57) ABSTRACT

An emitter for an ion thruster. The emitter is a field-effect emitter for a field emission electric propulsion or colloid thruster. The field-effect emitter has a first and second portions defining an internal reservoir for supplying a liquid metal or a conducting ionic liquid and has a slit connecting the internal reservoir to an exit orifice.

20 Claims, 4 Drawing Sheets

OTHER PUBLICATIONS

Pelagatti, Marco, "Tesi di laurea vecchio ordinamento," (English abstract) Internet citation, Jul. 2005, XP007903130, URL: http://etd.adm.unipi.it/theses/available/etd-06072005-102443, 4 pages.

Pelagatti, Marco, "Studio Preliminare Per La Realizzazione Di Propulsori Feep Ad Alta Spinta Mediante L'Aumento Del Numero Di Punti Di Emissione," Thesis, Universita degli studi di Pisa, Jul. 4, 2005.

* cited by examiner

EMITTER FOR IONIC THRUSTER

FIELD OF THE INVENTION

This invention relates to an emitter for an ion thruster.

More specifically, the invention relates to a field-effect emitter for a field emission electric propulsion or colloid thruster, comprising a first portion and a second portion defining an internal reservoir for supplying a liquid metal or a conducting ionic liquid, and a slit connecting the internal reservoir to an exit orifice.

PRIOR ART

Field emission electric propulsion (FEEP) thrusters have been known since the 1970s.

These thrusters are supplied either with liquid cesium (which has a melting point of 28.5° C.), or liquid indium.

More recently, it has been proposed that novel electrically conducting liquids be used for colloid thrusters employing a geometry similar to that of FEEP thrusters.

Examples of ion thrusters are described in the following publication: "Field emission electric propulsion development status", C. Bartoli and D. Valentian, 17$^{th}$ IEPC Tokyo, May 1984 (IEPC International Electric Propulsion Conference).

These thrusters are characterized by a wide dynamic range and are proposed for missions requiring very precise relative positioning such as the LISA (Laser Interference Space Antenna) mission or compensation for drag and external disturbances, such as the MICROSCOPE mission, which was designed to test the equivalence principle of general relativity.

The building of an ion thruster for space applications using a linear-type field effect emitter has already been proposed, as for example in U.S. Pat. No. 4,328,667 (Valentian et al.).

FIGS. 2-4 show an example of this kind of known linear emitter.

The linear emitter 10 comprises a first portion 11 and a second portion 12 which are superposed and define between themselves a reservoir 16 (formed for example in the lower portion 12) connected to a linear slit 17 which opens to the exterior through a linear orifice extending across the full width of the slit 17.

The superposed portions 11 and 12 are connected by connection means such as M2 screws passing through orifices 18 formed in the two portions 11 and 12.

The slit 17, which is 1.5 micrometers thick, is produced by vacuum deposition on the portion 11, through a mask, of a spacer 19 made of pure nickel, for example. The U-shaped spacer 19 has a rear arm and two side arms either side of the slit 17. The minimum width of the slit is maintained by nickel blocks 15 deposited on the portion 11 through the mask (FIG. 3).

FIG. 4 is a cross section showing the emitter 10 in conjunction with an accelerating electrode 20 raised to a potential of −500 to −5 000 V, which creates a powerful electric field at the tip of the emitter 10 whose potential is from +5 000 to +10 000 V.

The liquid (cesium, for example) is introduced through a duct 13 into the reservoir 16 and then expelled through the slit 17.

The liquid meniscus is deformed by the electrostatic forces into Taylor cones. The field at the tip of the cone allows the ions to be extracted directly from the liquid surface. Edge effects are limited by rounding the ends of the emitter.

Operation requires perfect wetting with the liquid. This requires heating under vacuum which can be provided by a heating resistor (up to a temperature of around 200° C.).

After cooling, the cesium or other liquid is introduced into the emitter.

It is however very difficult to make flat emitters, such as that shown in FIGS. 2-4, with a slit length of more than 70 mm that are straight and planar to within 1 micrometer, and with a surface finish of 0.05 μm rms or better.

Linear emitter technology has no difficulty producing thrusts of less than 1 mN, but becomes more difficult at higher thrusts, of around 5 to 10 mN for example.

A high thrust is required for example to compensate for drag in satellites in low orbit or for planetary missions requiring a large velocity increment (more than 15 km/s).

Patent documents FR-A-2 510 304 and U.S. Pat. No. 4,328,667 and the publication "Development of an annular slit source ion source for field emission electric propulsion" by M. Andrenucci, G. Genuini, D. Laurini and C. Bartoli; AIAA 85-2069, 18th International Electric Propulsion Conference, Alexandria, Va., have proposed a circular emitter designed to eliminate the problem of edge effects.

So far, however, this type of emitter has met with production difficulties and has not worked satisfactorily.

OBJECT AND BRIEF DESCRIPTION OF THE INVENTION

It is an object of the invention to solve the above problems, and in particular to make it possible to build ion thrusters with a thrust greater than 1 mN, typically of around 5 to 10 mN, in a simplified and reliable process ensuring highly accurate construction.

It is also an object of the invention to provide an emitter capable of working both on the ground in a horizontal or vertical firing position and in space in microgravity.

These objects are achieved with a field-effect emitter for a field emission electric propulsion or colloid thruster, comprising a first portion and a second portion having symmetry of revolution and defining an internal reservoir for supplying a liquid metal or a conducting ionic liquid, and a slit connecting the internal reservoir to an exit orifice, which emitter is characterized in that the first portion forms an external portion with a polished external face and a precision-machined internal face having conical sections with a single defined slope of between 5° and 8°, in that the second portion forms an internal portion with an internal face and a precision-machined external face having conical sections with a single slope of between 5° and 8°, the internal face of the external portion and the external face of the internal portion defining said internal reservoir and said slit, in that metal blocks are formed by deposition on the external face of the internal portion to define a thickness of between 1 and 2 micrometers for said slit, in that the external portion is held against the internal portion by connection means, and in that it also comprises a capillary supply channel of between 10 and 15 micrometers thickness formed between the internal reservoir and the slit and defined by conical surfaces on the internal face of the external portion and on the external face of the internal portion to supply this slit by capillary action from the reservoir.

More particularly, the emitter is characterized in that the exit orifice of the slit is a circular orifice whose radius is between 5 and 50 mm and which is defined by external and internal lips formed by the edges of the external and internal portions and whose alignment is adjustable by a sealing spacer inserted between bearing surfaces of the first and second portions which lie at right angles to the axis of symmetry of said first and second portions.

Advantageously, the conical surface of the internal face of the external portion has three conical segments, all of the same slope but having progressive conical transitions from one to the other, in such a way as to define said capillary supply channel, said internal reservoir and said slit.

One particular feature is that the emitter also comprises a supply channel with a diameter of between 1 and 2 millimeters formed in the second portion and leading to the internal reservoir to supply the latter from an external fluid source.

Making an emitter with a circular slit automatically protects against edge effects (high currents at the ends).

The particular structure recommended for the circular-slitted emitter enables the accurate construction of a circular slit measuring for example 1.5 micrometers across a diameter of 30 to 100 mm owing to the geometry which allows self-centering and ensures the possibility of adjustment, in such a way as to achieve an accuracy that could not be obtained by simple machining.

The invention also relates to the application of the emitter to a field emission electric thruster or colloid thruster, the emitter being mounted in the vicinity of an accelerating electrode structure which in turn is surrounded by a screen connected to ground, and insulating blocks are inserted between the emitter and the accelerating electrode structure as well as between the accelerating electrode structure and the grounded screen.

BRIEF DESCRIPTION OF THE DRAWINGS

Other features and advantages of the invention will be shown in the following description of certain particular embodiments of the invention, given as examples, referring to the appended drawings, in which.

DETAILED DESCRIPTION OF PARTICULAR EMBODIMENTS OF THE INVENTION

Figure 5:
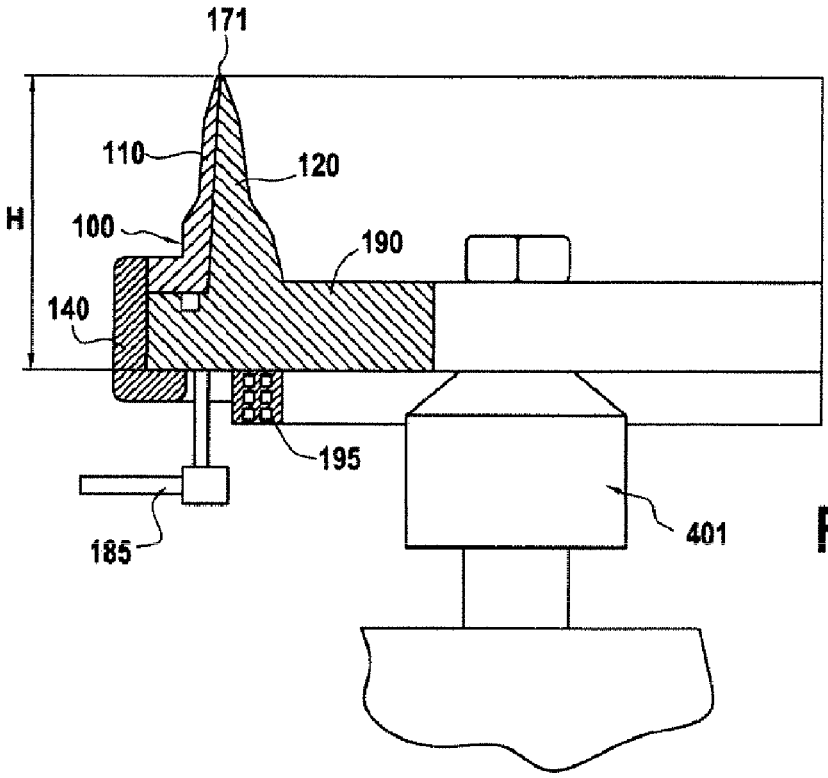
FIG. 5 is an axial half-section through a complete circular emitter according to the invention.
Figure 6:
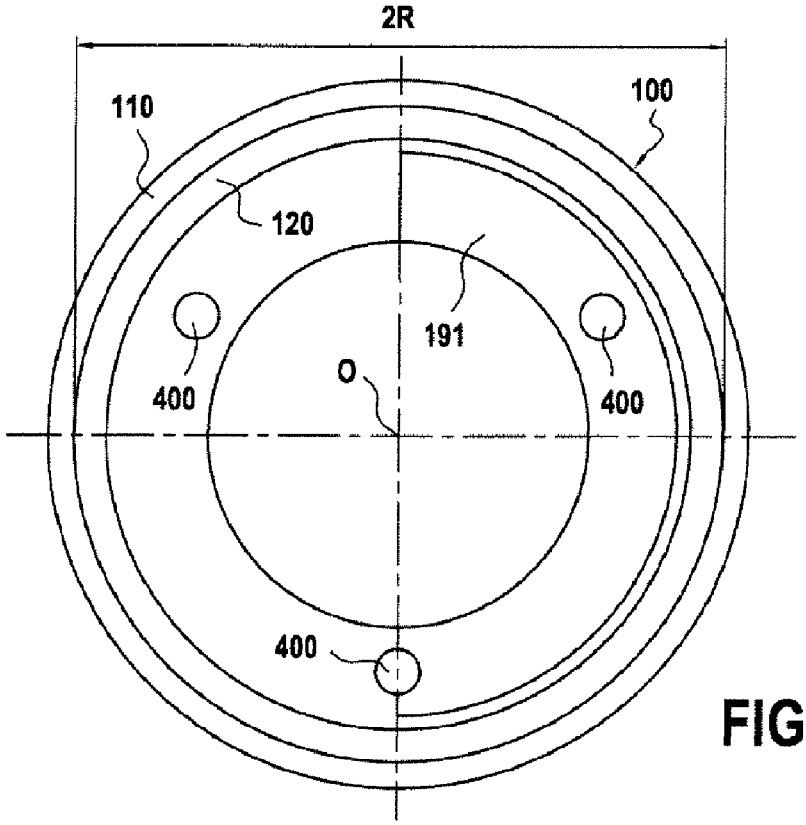
FIG. 6 is an end view of the emitter shown in FIG. 5.
Figure 7:
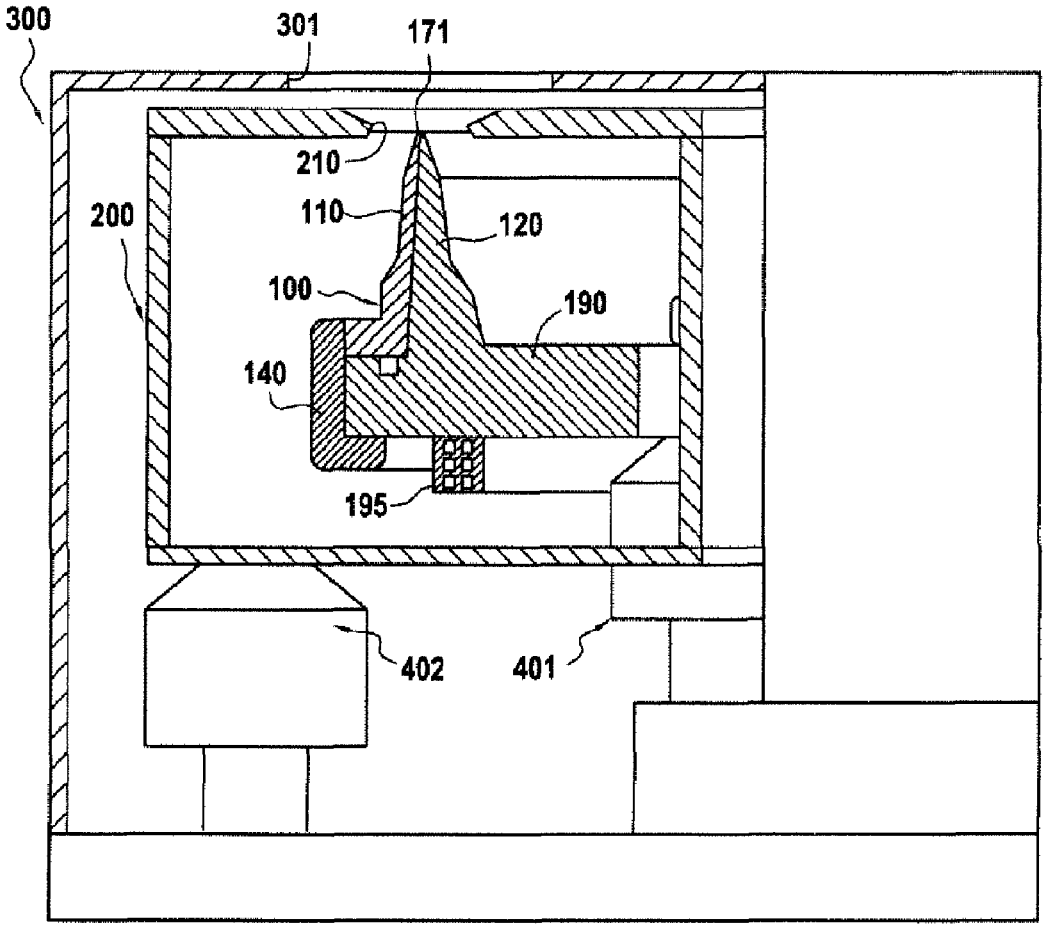
FIG. 7 is an axial half-section through an example of an ion thruster incorporating a circular emitter according to the invention.

FIGS. 5 and 6 show the general structure of an example of a circular emitter 100 according to the invention, and FIG. 7 shows how such a circular emitter 100 is incorporated in an ion thruster.

The emitter 100 comprises an internal part 120 having symmetry of revolution about an axis O, with a base 190 and a projecting portion whose external face 122 (FIG. 1) acts in conjunction with the internal face 112 of an external part 110 which also has symmetry of revolution about the axis O, is fitted onto the internal part 120, and is held against this internal part 120 by connecting means such as a nut 140.

An internal reservoir and a circular slit, neither of which is shown in FIGS. 5-7, are defined between the internal and external parts 120 and 110, as will be explained below with reference to FIG. 1.

FIG. 7 shows how the circular emitter 100 is incorporated in an ion thruster such as a field-emission or colloid thruster.

The emitter 100 is mounted close to an accelerating electrode structure 200 which surrounds the emitter 100.

The accelerating electrode structure 200 is surrounded by a screen 300 connected to ground. Insulating blocks 401, 402 are placed between the emitter 100 and the accelerating electrode structure 200, and also between the accelerating electrode structure 200 and the grounded screen 300. The base plate 190 of the internal part 120 comprises holes 400 (FIG. 6) for the passage of the high-voltage insulating blocks, such as the block 401, of the emitter 100 and for the passage of the pipes 185 (FIG. 5) supplying the internal reservoir with liquid, such as cesium.

The grounded screen 300 prevents interactions between the external plasma created on the outside of the orifice 171 of the circular slit defined between the parts 110 and 120, and the charged electrodes 200.

When operated on the ground, the external plasma results from the operation of the hollow-cathode neutralizer situated outside of the screen in the vicinity of the output orifice 171 of the circular slit of the emitter 100.

The accelerating electrode 200 and the screen 300 comprise annular openings 201, 301 aligned with the circular output orifice 171 of the slit of the emitter 100 (FIG. 7).

A heating resistor 195 (FIGS. 5 and 7) may be positioned in the vicinity of the internal part 120, beneath the base 190, in the vicinity of the liquid supply pipes 185, to heat the emitter, which is then cooled, and then to maintain the liquid state in the emitter proper, which consists of the parts 110 and 120.

In one particular embodiment, the shoulder formed by the base 190 and the internal part 120 may be of a reduced height and a separate plate 191 may be superimposed on this base 190 (the variant shown on the right-hand side of FIG. 6).

The potential of the accelerating electrode 200 is strongly negative (−1000 V to −5000 V) and attracts the plasma ions. The accelerating electrode 200 is efficiently protected against too high a current of ions caused by the ionosphere plasma and the neutralizer, by means of the screen 300, which in particular surrounds the central portion of the accelerating electrode 200 inside the emitter.

The special structure of the circular emitter 100 according to the invention will now be described with reference to FIG. 1, which shows more details than the simplified assembly views of FIGS. 5-7.

The internal part 120 has an internal face 121 whose surface condition is not critical, and an external face 122 produced by precision machining and polished, having conical portions with a defined single slope of 5° and 8°.

The external part 110 has a polished external face 111 and an internal face 112, the latter being produced by precision machining and having ion portions with a defined single slope of between 5° and 8°.

The internal face 112 of the external part 110 and the external face 122 of the internal part 120 define an annular internal reservoir 160 and an annular slit 170 leading to a circular orifice 171.

Metal blocks 123, 124, 125, e.g. of nickel, are vacuum-deposited, by cathode sputtering for instance, on the portion of the external face 122 of the internal part 120, to determine the width of the slit 170. Vacuum deposition of the blocks can be done using a slitted conical mask. When the two conical parts are fitted together, the sliding of the studs over the opposite surface is only for example 160 μm for a 16 μm gap and a 10% (6°) slope. This brief rubbing movement limits the risk of the blocks being knocked off. In another possible embodiment, the blocks may be machined directly, with a tool lift of 1 to 2 μm.

Figure 1:
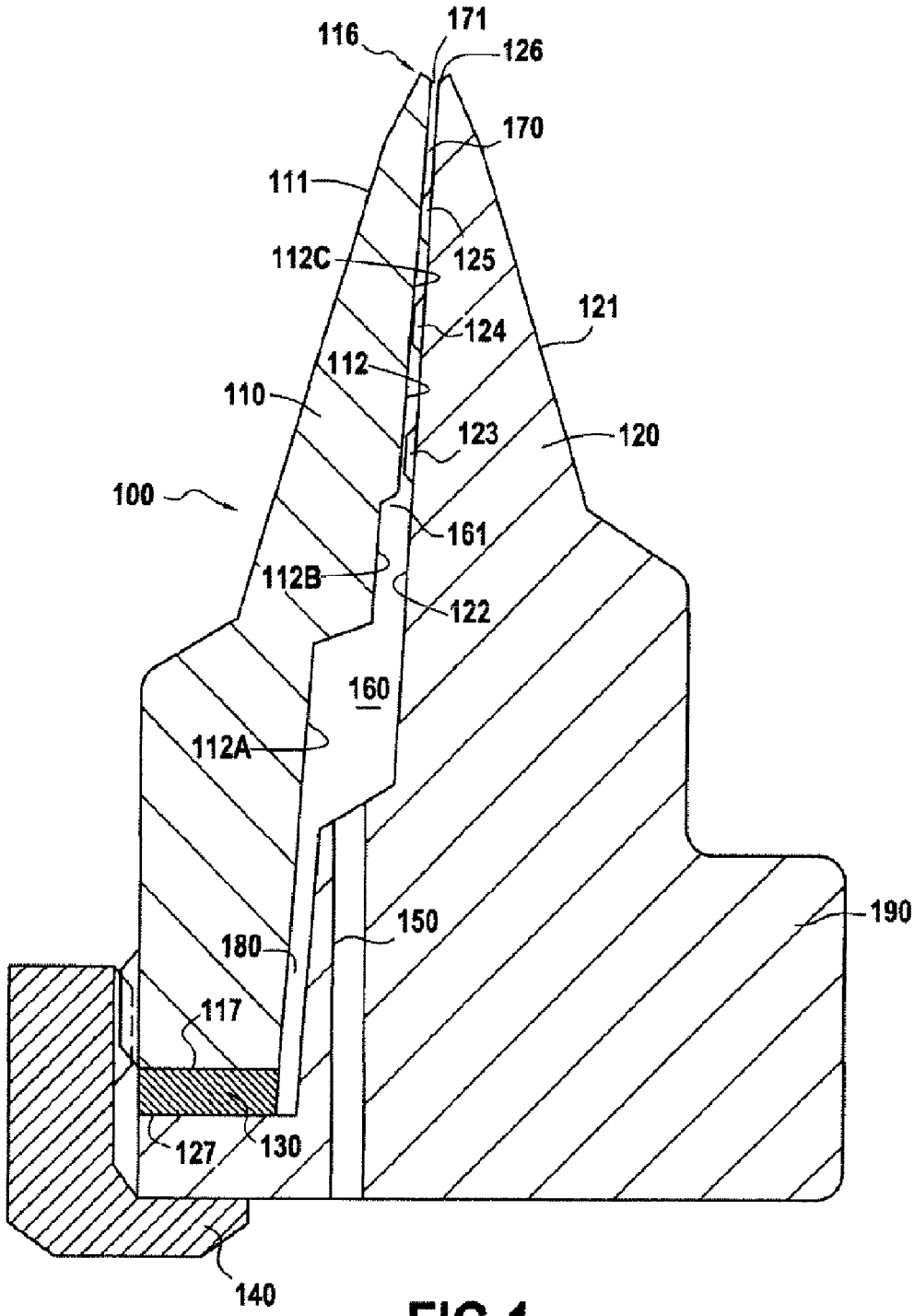
FIG. 1 is an axial half-section through the main parts of an example of a circular emitter according to the invention.
Figure 2:
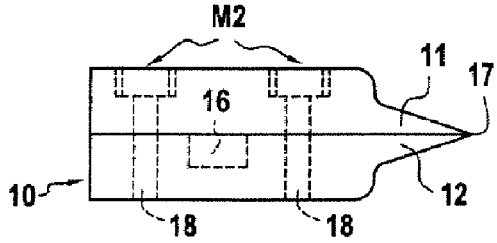
FIG.2 PRIOR ART
FIG. 2 is a side view of an example of a known linear-slit emitter.
Figure 3:
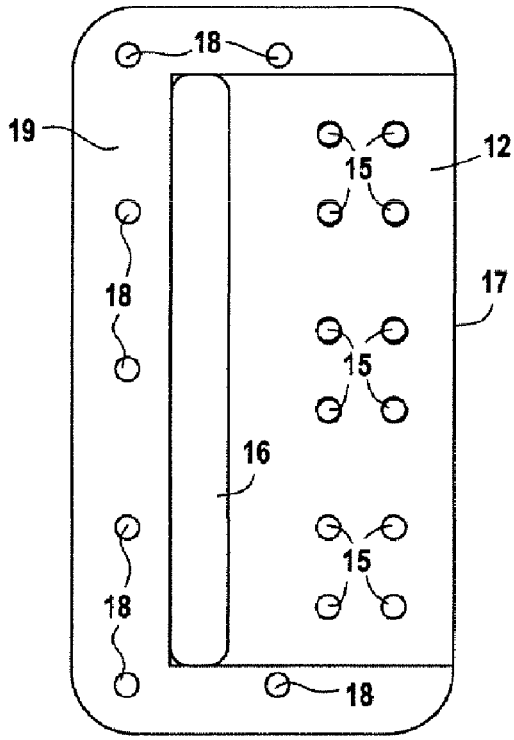
FIG.3 PRIOR ART
FIG. 3 is a top view of an example of a spacer vacuum-deposited on a lower portion of a linear-slit emitter such as that shown in FIG. 2.

The geometry proposed in an embodiment such as that shown in FIG. 1 gives a slit thickness of between one and two micrometers, depending on the desired fluid impedance, typically a thickness of 1.5 micrometers. Lips 116, 126 formed by the ends of the external and internal parts 110, 120 and defining the circular exit orifice 171 can be aligned to within 1 micrometer for radii of the exit orifice 171 which may be between 5 and 50 mm.

The vertical alignment of the lips 116, 126 is adjustable by finish-grinding a sealing spacer 130 which is inserted between bearing surfaces 117, 127 of the external and internal parts 110, 120 that lie at right angles to the axis of symmetry O of these parts 110, 120.

The spacer 130 is preferably made of nickel and also seals the parts 110 and 120 to prevent liquid leaking out at the bottom of the external part 110.

The parts 110 and 120 are closed together by mechanical connection means such as screws or brazing. In the example shown in FIG. 1, the mechanical connection between the parts 110 and 120 gripping the spacer 130 is preferably a fine-pitched nut 140.

As a variant, a mechanical connection can be provided using a flange and a series of M3 screws. This assumes that any non-parallelism can be attenuated by discrete as opposed to continuous rotation.

As can be seen in FIG. 1, the internal face 112 of the external part 110 has three conical segments 112A, 112B, 112C, all of the same slope but not aligned with each other, and connected to each other by progressive conical transitions so that the meniscus of the liquid is not obstructed by a sudden change of diameter, while the external face 122 of the internal part 120 has a single conical face in its upper portion to define, on the one hand, the internal reservoir 160, in conjunction with segment 112A, and, on the other hand, in the upper portion where the blocks 123 to 125 are located, the annular slit 170 in conjunction with segment 112C.

The intermediate segment 112B and the corresponding slope of the face 122 define a capillary supply channel 161 whose diameter is between 10 and 15 micrometers, between the internal reservoir 160 and a slit 170 to allow the liquid to rise by capillary action from the internal reservoir 160 to the narrow slit 170, regardless of the position of the emitter. The capillary supply channel 161 promotes the supply to the narrow slit 170 in all conditions and also allows firing with the axis horizontal, for example.

The small volume 160 defined by the lower segment 112A of the conical face 112 and the conical face 122 may correspond for instance to an average difference between the radius of the segment 112A and that of the conical face 112 of around 1.5 to 2 mm and simultaneously allows degassing of the emitter and provides a buffer reservoir within the emitter for a liquid such as cesium destined to be ejected from the orifice 171.

The internal part 120 may have a height H between the lower surface of its base 190 and the orifice 171 of between 20 and 30 mm for example.

The internal reservoir 160 may be supplied by external pipes 185 (FIG. 5) through a hole 150 with a diameter of for example between 1 and 2 millimeters in the base 190 of the internal part 120.

The slopes of the different segments 112A, 112B, 112C of the finish-ground internal face 112 of the external part 110 are preferably identical to each other. This makes machining and assembly easier. The slope, which is between 5° and 8°, is determined by machining constraints.

The internal part 120 is preferably designed to be much stiffer than the external part 110. It will be seen for example in FIG. 1 that the internal part 120 is more massive than the complementary part 110.

The internal and external parts 120, 110 may for example be made of a nickel super alloy, or a hardened stainless steel.

The surfaces to be machined 112, 122 should usually be made on a hard substrate. A nickel super alloy such as INCONEL 718, or a hardened stainless steel chemically plated with a layer of nickel are thus very suitable materials for producing parts 110 and 120.

The polished faces of the parts 110, 120, such as the external and internal faces 111, 112 of the external part 110, the external face of the internal part 120, or the end parts defining the lips 116, 126 with external faces having a slope of around 30° relative to the vertical (according to the configuration of FIG. 1), are preferably produced by diamond-machining them directly on a precision machine, using the technique used for making metal mirrors.

These polished areas, and especially the surfaces defining the slit 170 and the external surface subjected to the electric field, should preferably be polished to a smoothness of 0.025 μm rms.

The straightness of the surfaces adjacent to the slit 170 and at the lips 116, 126 must be very good. On the other hand, surface defects are tolerable on the external surface 111 because on this surface the purpose of polishing is to prevent local discharges from microelevations.

Noncritical areas of the surfaces of parts 110 and 120 may have a surface finish of around 0.2 micrometers.

The emitter structure according to the invention provides a circular slit 170 with a narrow width of for example preferably between 1 and 1.8 micrometers, and an alignment of the lips 116, 126 to within 1 micrometer, even for a slit 170 whose exit orifice 171 has a radius R of between 15 and 50 mm.

It is possible because the geometry of the emitter allows self-centering and the ability to make adjustments, so that it is no longer necessary to achieve the required precision by machining only.

The invention simplifies the construction of the emitter 100 because it is easier, for the purposes of assembling the external part 110 onto the internal part 120, to give the contact surface 112 a conical slope than to assemble by means of differential expansion.

The conical method of assembly used for constructing the emitter 100 also allows this assembly several times. It is thus possible to align the lips 116, 126 by rotating the external part 110, and so correct faults of parallelism of the lips 116, 126 relative to the reference faces, and also by finish-grinding the spacer 130 at the bottom of the external part 110, to compensate for the height difference between the external and internal parts 110, 120.

Figure 4:
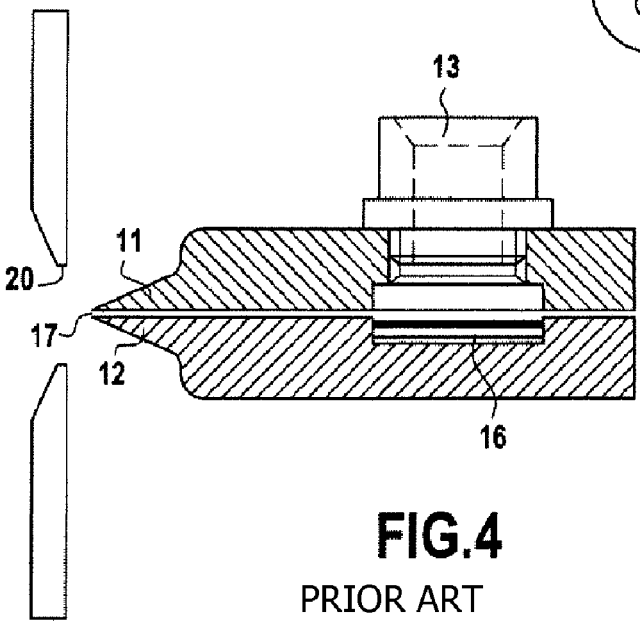
FIG.4 PRIOR ART
FIG. 4 is a cross section through an ion thruster incorporating a linear-slit emitter such as that shown in FIG. 2.

The emitter 100 can be degassed by the conductance of the slit 170 and of a liquid filling duct, similar to the duct 13 in the linear emitter of FIG. 4, in a ground-testing configuration. In space, however, degassing can be done through a dedicated orifice or by using a degassing getter material incorporated in the cavity 160, 161 between the external and internal parts 110, 120 through which liquid is supplied to the slit 170. The term "getter" is used for a range of reactive metals used in vacuum tubes to improve the vacuum.

The invention claimed is:

1. A field-effect emitter for a field emission electric propulsion or colloid thruster, comprising a first portion and a second portion having symmetry of revolution and defining an internal reservoir for supplying a liquid metal or a conducting ionic liquid, and a slit connecting the internal reservoir to an exit orifice, for emitting the liquid metal or ionic liquid to produce thrust, wherein the first portion forms an external portion with a polished external face and an internal face having conical sections with a single defined slope of between 5 degrees and 8 degrees, wherein the second portion forms an internal portion with an internal face and an external face having conical sections with a single slope of between 5 degrees and 8 degrees, the internal face of the external portion and the external face of the internal portion defining said internal reservoir and said slit, wherein metal blocks are formed by deposition on the external face of the internal portion to define a thickness of between 1 and 2 micrometers for said slit, wherein the external portion is held against the internal portion by a mechanical connection, and wherein said field-effect emitter further comprises a capillary supply channel of between 10 and 15 micrometers thickness formed between the internal reservoir and the slit and defined by conical surfaces on the internal face of the external portion and on the external face of the internal portion to supply the slit by capillary action from the reservoir.

2. The field-effect emitter as claimed in claim 1, wherein the exit orifice of the slit is a circular orifice having a radius between 5 and 50 mm and which is defined by external and internal lips formed by the edges of the external and internal portions and wherein the alignment of said external and internal lips is adjustable by a sealing spacer inserted between bearing surfaces of the first and second portions which lie at right angles to an axis of symmetry of said first and second portions.

3. The field-effect emitter as claimed in claim 2, wherein the sealing spacer is made of nickel.

4. The field-effect emitter as claimed in claim 2, wherein the conical sections of the internal face of the external portion have three conical segments, all having the same slope and having progressive conical transitions from one to the other, thereby defining said capillary supply channel, said internal reservoir and said slit; and wherein said field-effect emitter also comprises a supply channel with a diameter of between 1 and 2 millimeters formed in the second portion and leading to the internal reservoir to supply said internal reservoir from an external fluid source.

5. A field emission electric propulsion or colloid thruster, comprising a field-effect an emitter as claimed in claim 4, which field-effect emitter is mounted proximate an accelerating electrode structure which in turn is surrounded by a screen connected to ground, and insulating blocks are inserted between the field-effect emitter and the accelerating electrode structure and between the accelerating electrode structure and the screen connected to ground.

6. The field-effect emitter as claimed in claim 1, wherein the conical sections of the internal face of the external portion have three conical segments, all having the same slope and having progressive conical transitions from one to the other, thereby defining said capillary supply channel, said internal reservoir and said slit.

7. The field-effect emitter as claimed in claim 1, further comprising a supply channel with a diameter of between 1 and 2 millimeters formed in the second portion and leading to the internal reservoir to supply said internal reservoir from an external fluid source.

8. The field-effect emitter as claimed in claim 7, wherein the mechanical connection comprises one of a nut, screws and brazed joint;

wherein the first and second portions are made of one of a nickel super alloy and hardened stainless steel;

wherein said field-effect emitter comprises a degassing getter material incorporated in a cavity formed between the first and second portions;

wherein said metal blocks are made of nickel and by direct machining;

wherein the second portion is stiffer than the first portion; and wherein said field-effect emitter also comprises a heating resistor located proximate the second portion.

9. A field emission electric propulsion or colloid thruster, comprising a field-effect emitter as claimed in claim 8, which emitter is mounted proximate an accelerating electrode structure which in turn is surrounded by a screen connected to ground, and insulating blocks are inserted between the field-effect emitter and the accelerating electrode structure and between the accelerating electrode structure and the screen connected to ground.

10. The field-effect emitter as claimed in claim 1, wherein the mechanical connection comprises a nut.

11. The field-effect emitter as claimed in claim 1, wherein the mechanical connection comprises screws.

12. The field-effect emitter as claimed in claim 1, wherein the mechanical connection comprises a brazed joint.

13. The field-effect emitter as claimed in claim 1, wherein the first and second portions are made of a nickel super alloy.

14. The field-effect emitter as claimed in claim 1, wherein the first and second portions are made of a hardened stainless steel.

15. The field-effect emitter as claimed in claim 1, comprising a degassing getter material incorporated in a cavity formed between the first and second portions.

16. The field-effect emitter as claimed in claim 1, wherein said metal blocks are made of nickel.

17. The field-effect emitter as claimed in claim 1, wherein said metal blocks are made by direct machining.

18. The field-effect emitter as claimed in claim 1, wherein the second portion is stiffer than the first portion.

19. The field-effect emitter as claimed in claim 1, further comprising a heating resistor located proximate the second portion.

20. A field emission electric propulsion or colloid thruster, comprising a field-effect emitter as claimed in claim 1, which field-effect emitter is mounted proximate an accelerating electrode structure which in turn is surrounded by a screen connected to ground, and insulating blocks are inserted between the field-effect emitter and the accelerating electrode structure and between the accelerating electrode structure and the screen connected to ground.

* * * * *

UNITED STATES PATENT AND TRADEMARK OFFICE

CERTIFICATE OF CORRECTION

PATENT NO. : 8,365,512 B2
APPLICATION NO. : 12/527916
DATED : February 5, 2013
INVENTOR(S) : Dominique Valentian It is certified that error appears in the above-identified patent and that said Letters Patent is hereby corrected as shown below:

Title page, (74) Attorney, Agent, or Firm reads: "Preti Flahery Beliveau & Pachios LLP" should read --Preti Flaherty Beliveau & Pachios LLP--.

Signed and Sealed this
Thirteenth Day of August, 2013

Teresa Stanek Rea
*Acting Director of the United States Patent and Trademark Office*